US007318758B2

(12) United States Patent
Haller

(10) Patent No.: US 7,318,758 B2
(45) Date of Patent: Jan. 15, 2008

(54) PLUG CONNECTOR FOR THE ELECTRICAL CONNECTION OF SOLAR PANELS

(75) Inventor: Wolfgang Haller, Schwaikheim (DE)

(73) Assignee: Hirschmann Automation and Control GmbH, Neckartenzlingen (DE)

( * ) Notice: Subject to any disclaimer, the term of this patent is extended or adjusted under 35 U.S.C. 154(b) by 0 days.

(21) Appl. No.: 10/573,560

(22) PCT Filed: Feb. 5, 2005

(86) PCT No.: PCT/EP2005/001185

§ 371 (c)(1),
(2), (4) Date: Mar. 27, 2006

(87) PCT Pub. No.: WO2005/096450

PCT Pub. Date: Oct. 13, 2005

(65) Prior Publication Data

US 2007/0049125 A1 Mar. 1, 2007

(30) Foreign Application Priority Data

Mar. 16, 2004 (DE) ..... 10 2004 012 883

(51) Int. Cl.
*H01R 13/187* (2006.01)

(52) U.S. Cl. ..... 439/843; 439/357; 439/747; 439/750

(58) Field of Classification Search ..... 439/843, 439/839, 272, 851, 357, 747, 750
See application file for complete search history.

(56) References Cited

U.S. PATENT DOCUMENTS 4,637,674 A 1/1987 Kobler
4,666,227 A * 5/1987 Galizia et al. ..... 439/252
4,676,569 A * 6/1987 Lambert et al. ..... 439/133
4,772,231 A * 9/1988 Hayes ..... 439/752
4,793,476 A * 12/1988 Schrupp ..... 206/222
4,832,615 A 5/1989 Thakrar et al.
5,437,566 A * 8/1995 Zinn et al. ..... 439/839
5,588,852 A * 12/1996 Puerner ..... 439/135
5,938,486 A * 8/1999 Durand-Cochet et al. ... 439/839
6,186,841 B1 * 2/2001 Jacobsson ..... 439/851
6,367,293 B1 * 4/2002 Elliott ..... 70/57

* cited by examiner

*Primary Examiner*—Neil Abrams
*Assistant Examiner*—Phuongchi Nguyen
(74) *Attorney, Agent, or Firm*—Andrew Wilford

(57) ABSTRACT

The invention relates to a plug connector for exterior application, in particular, for the electrical connection of solar panels, comprising a plug (16) with a plug housing (14), comprising at least one contact pin (3), or contact sleeve (13) and a coupling (1) comprising a coupling housing (2), with at least one contact sleeve (13) or contact pin (3), whereby the plug (16) and the contact pin (3) may be at least partly plugged into the coupling (1) and the contact sleeve (13). The contact pin (3) and the contact sleeve (13) may each be connected to at least one cable conductor (12) of a cable (4) and the plug (16) and the coupling (1) each comprise a locking piece of a locking unit for fixing the plug (16) and coupling (1) to each other. A seal is provided on each of the plug housing (14) and coupling housing (2) for each outer sleeve of the cable (4) and the contact pin (3) and the contact sleeve (13) each comprise at least one clip hook (7) which engages with a shoulder after introduction of the contact pin (3) and the contact sleeve (13) into the corresponding plus housing (14) and coupling housing (2), located within the same.

9 Claims, 4 Drawing Sheets

PLUG CONNECTOR FOR THE ELECTRICAL CONNECTION OF SOLAR PANELS

CROSS REFERENCE TO RELATED APPLICATIONS

This application is the U.S. national phase of PCT application PCT/EP2005/001185, filed 5 Feb. 2005, published 13 Oct. 2005 as WO 2005/096450, and claiming the priority of German patent application 102004012883.9 itself filed 16 Mar. 2004.

The invention relates to a plug connector for exterior applications especially for the electrical connection of solar panels, the plug connector being comprised of a plug with a plug housing that has at least one contact pin or a contact sleeve, and of a coupling with a coupling housing that has at least one contact sleeve or a contact pin, whereby the plug and the contact pin are insertable at least partly into the coupling and the contact sleeve, whereby the contact pin and the contact sleeve are each respectively connectable by means of a crimp connection with at least one cable conductor of a cable and whereby the plug and the coupling each have a locking part of a locking unit for fixing the plug and coupling with respect to one another, and whereby on the plug housing and on the coupling housing there are respective seals against the respective outer jackets of the cables.

Such a plug connector is known form DE 102 15194 A1. Both the plug housing and the coupling housing of this plug connector have in the regions of the seals of a screwthread and a locking nut threaded onto the screwthread whereby the screwthread and locking nut can be used for clamping the seals. Furthermore, the locking unit for fixing the plug and coupling together is formed by a threaded connection that on its part is secured by means of a protective sleeve the result overall is therefore a very expensive plug connector that is costly to fabricate.

The invention by contrast has as its object to provide a plug connector that satisfies all requirements but is substantially less costly and simpler to manufacture. Furthermore, it should also be able to be connected rapidly and simply with the respective cables.

These objects are achieved with the features of patent claim 1.

According to the invention it is provided that the contact pin and the contact sleeve each have at least one detent hook that, after insertion of the contact pin and the contact sleeve in the respective housings engage behind respective shoulders in the plug housing and the coupling housing. The result is a simple and facile engagement of the contact pin and the contact sleeve in the respective plug housing and coupling housing, whereby the detent hook or detent hooks and the respective shoulder can be fabricated simply and from the respective materials from which the contact pin or contact sleeve are formed or wherein the shoulder can be formed on the plug housing or the coupling housing.

In an advantageous manner, the contact pin and the contact sleeve each have two detent hooks that are arranged diametrically opposite one another in a preferred mode, and the shoulder is formed as an annular or ring shoulder preferably in the plug housing and the coupling housing. In this manner, mounting is further simplified since no rotatable locking arrangement is required between the components. In order to secure the contact pin and the contact sleeve reliably in the plug housing and the coupling housing also in the other direction of movement, each of these is provided with a projection and the plug housing and the coupling housing each have a construction so that after the engagement of the detent hook or hooks behind the respective shoulder, the projection will come to abut against the respective constriction. In an advantageous manner and for easier manufacture, the projection is formed as an annular or ring shaped bead or bulge and the annular shoulder is formed as a component or part of that annular bulge. Thus an annular bulge can also form a constriction within the plug housing and each annular projection can be constituted as a widening on the contact pin and the contact sleeve, whereby the spacing from the annular proportion to the detent hook or detent hooks can correspond approximately to the annular bulge or bead in the plug housing or coupling housing.

The plug housing and the coupling housing can have in the region turned toward the respective cable can have a cylindrical widening or enlargement in which the respective seal is sealed and fixed. The seal can be advantageously cemented or otherwise adhesively bonded in the plug housing or the coupling housing or when the plug housing and coupling housing are fabricated from a plastic, can be injection molded or fabricated together with the plug housing and coupling housing by a two component technique. The seal is provided with circumferential grooves and rings at its surface turned toward the cable and thus can be formed with a kind of labyrinth seal. The result is an especially good and elastic sealing enabling also expansion and contraction as a result of temperature differences and volume differences in the air or gas that can be enclosed in the plug connection to compensate such expansion and contraction tendencies.

In an advantageous manner, the plug housing and the coupling housing in the region of the seals, each can have a longitudinally extending yield gap or crevice or one or more expansion openings. These facilitate especially the demolding of the plug housing and the coupling housing with the respective seals from the respective mold.

The seals and/or the plug housing and the coupling housing can have respective extensions against which the respective cables can lie to thereby elongate the sealing stretch and protect the cable especially with respect to excessively strong bending.

The plug housing and the coupling housing can also be fabricated from a metal material, preferably from a noncorroding metal this offers the possibility of adhesively bonding the seal or otherwise fastening the seal thereto. If the plug housing and/or the coupling housing is made from metal, advantageously between the plug housing and the coupling housing and the contact pin and contact sleeve, respective insulating bodies can be provided in order to limit electrical conductivity between the contact pin and the contact sleeve and the plug housing and/or the housing.

In a further feature of the invention it is proposed that within the plug or coupling housing respective further housings can engage and that on their ends turned away from the cable, respective sealing rings can be provided. These sealing rings can correspond to the seals between the plug housing and the coupling housing and the cable. They can in a single manufacturing operation be fabricated together with the seals on the cables, whereby both seals can be connected by a passage.

In an advantageous manner, the locking part of the plug housing or the coupling housing that is respectively surrounded by each of the other housings can be arranged at the ends turned away from the cable and can be configured as eyes and preferably two diametrically opposite eyes. These eyes correspond to locking hooks that spatially are provided to match the eyes on the plug housing or coupling housing and that can be inserted into the other housing. The eyes are formed free standing at the ends of the plug or coupling housing so that they are elastically yieldable and enable simple locking and unlocking.

Through this configuration of the plug connector in accordance with the invention, the plug and the coupling can be advantageously fabricated or mounted in an especially simple manner in accordance with the following steps. The cable is inserted through the seal in the respective plug housing and coupling housing and pushed through the latter. The cable is then insulated by a skilled worker in the art and the contact pin or the contact sleeve connected with the cable conductor of the cable by a crimping pliers or tool. Then the plug housing or the coupling housing are shoved sufficiently deeply in the direction toward the contact pin or the contact sleeve until they lock respectively in the plug housing or coupling housing by springing into place.

While in the above-described embodiments, only a single pole cable has been described, the cable connector can be expanded as will be self understood so as to be usable also for multipole cables.

An embodiment of the electrical connector of the invention with further features to which the invention is however not limited, is described below and in detail with respect to the figures. Therein:

Figure 1:
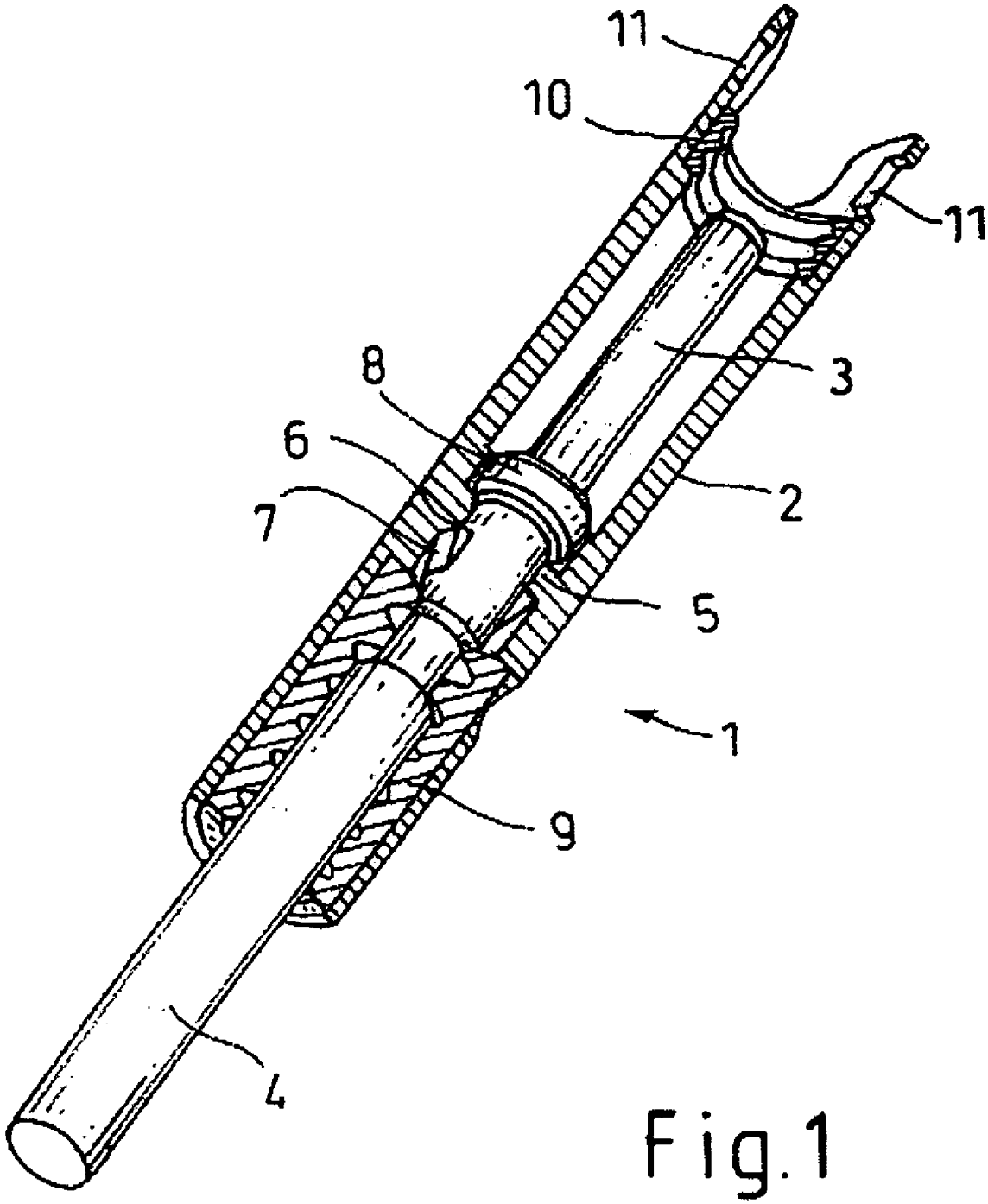
FIG. 1 is a section through a coupling housing with a view of the cable and contact pin.
Figure 2:
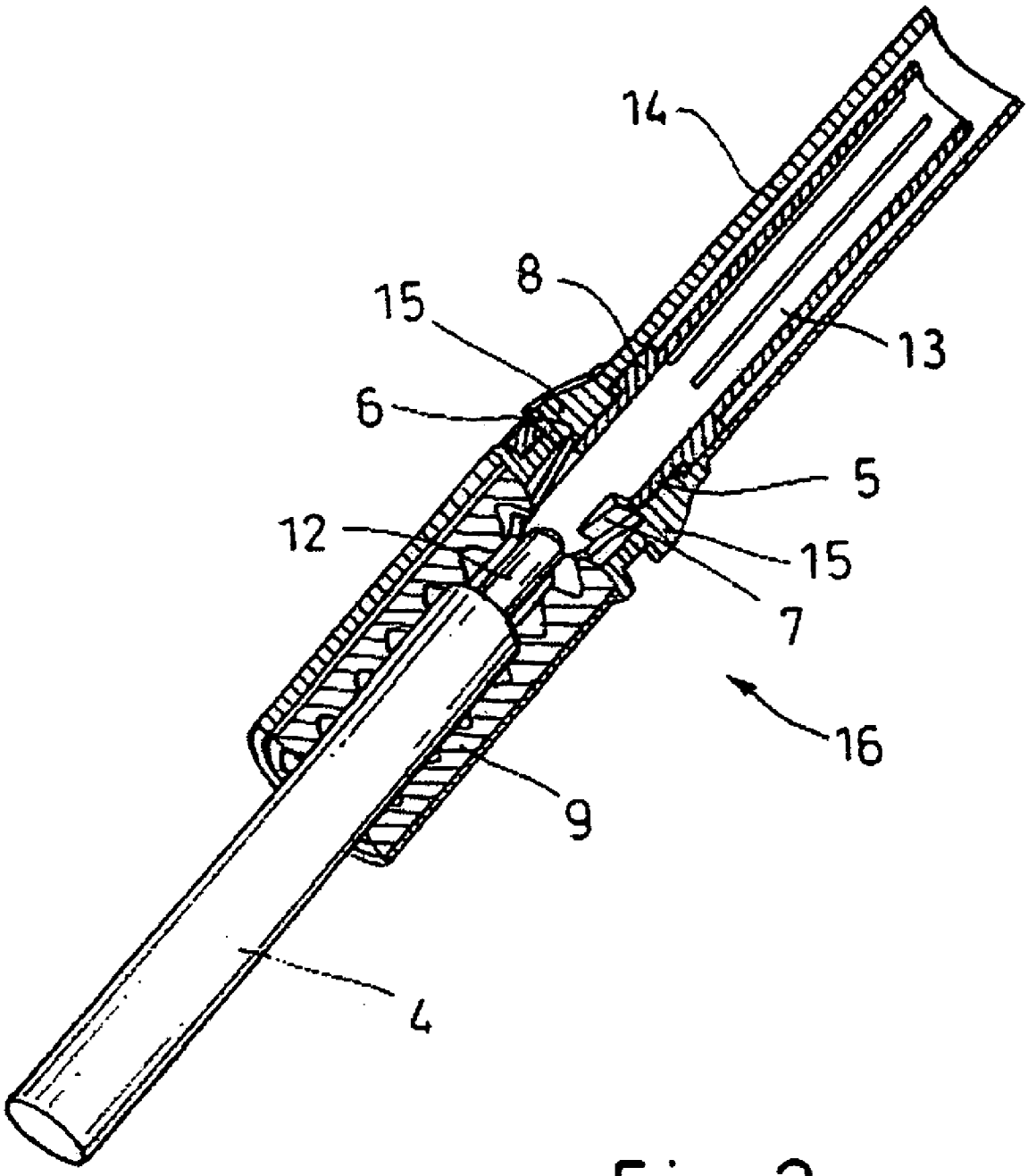
FIG. 2 is a section through a plug housing with a view of a cable and a section through a contact sleeve.
Figure 3:
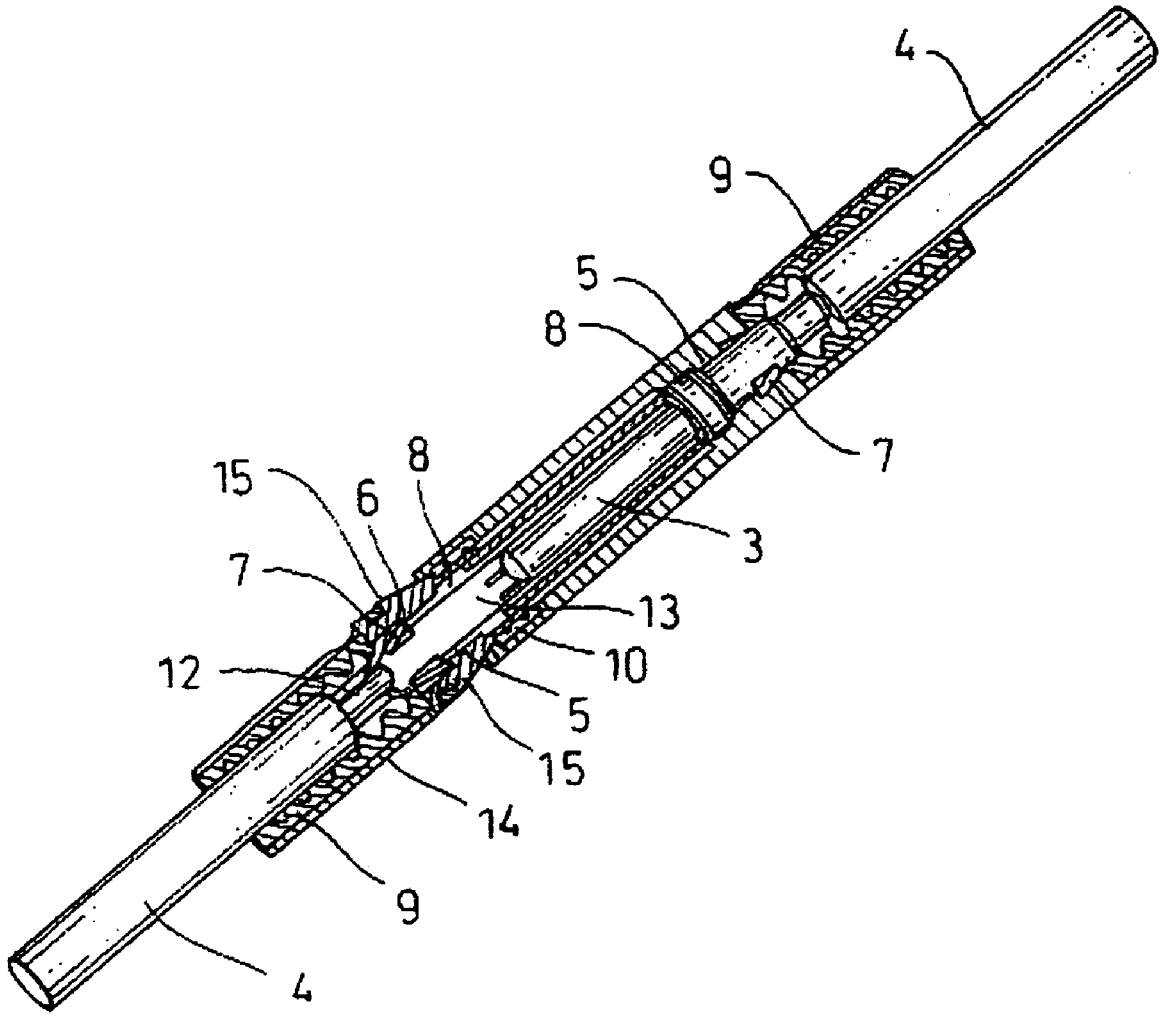
FIG. 3 is a plug connector with sections corresponding to FIGS. 1 and 2 in the interfitted state

In FIGS. 1 through 3 reference numeral 1 designates generally a coupling with a coupling housing 2, a contact pin 3 and a cable 4. The contact pin 3 is connected mechanically and electrically by a crimp connection with a cable conductor that is not visible but forms part of the cable 4. The coupling housing 2 has an annular bulge or bead 5 that forms a shoulder 6. The shoulder 6 is engaged by detent hooks 7 that are formed on the contact pin 3. The contact pin 3 in addition has a ring shaped or annular projection 8 that, after mounting of the contact pin 3 in the coupling housing 2, is braced counter to the detent hooks 7 and the shoulder 6 so that the contact pin is fixed in the coupling housing 2 in both axial directions. The coupling housing 2 has adjacent the cable 4 a seal 9 that is formed on its surface turned toward the cable 4 with grooves and ribs so that a very good seal and fit to the shape of the cable is produced. At the end of the contact pin 3 turned way from the cable, in the coupling housing 2, a sealing ring 10 is inserted that, as especially can be seen from FIG. 3, ensures a seal between the coupling housing 2 and the plug housing 14 described in FIG. 2. At the end of the coupling housing 2, two eyes 11 are provided that are configured as projecting lugs and that are elastically yieldable in the radial direction.

Differing from FIG. 1, the cable conductor indicated at 12 in FIG. 2, is affixed to a contact sleeve 13 also by means of a crimp connection. The contact sleeve differs with respect to the annular projection 8 and the detent hooks 7 not at all from the contact pin 3. The annular bead 5 is also correspondingly provided. The housing however is configured as the plug housing 14 and at the end turned toward the coupling housing 2 is thinner. The plug housing 14 has two locking hooks 15 that in the interfitted state (see FIG. 3) effectively engage with the eyes 11. The seal 9 also corresponds in its configuration to that of FIG. 1.

Figure 4:
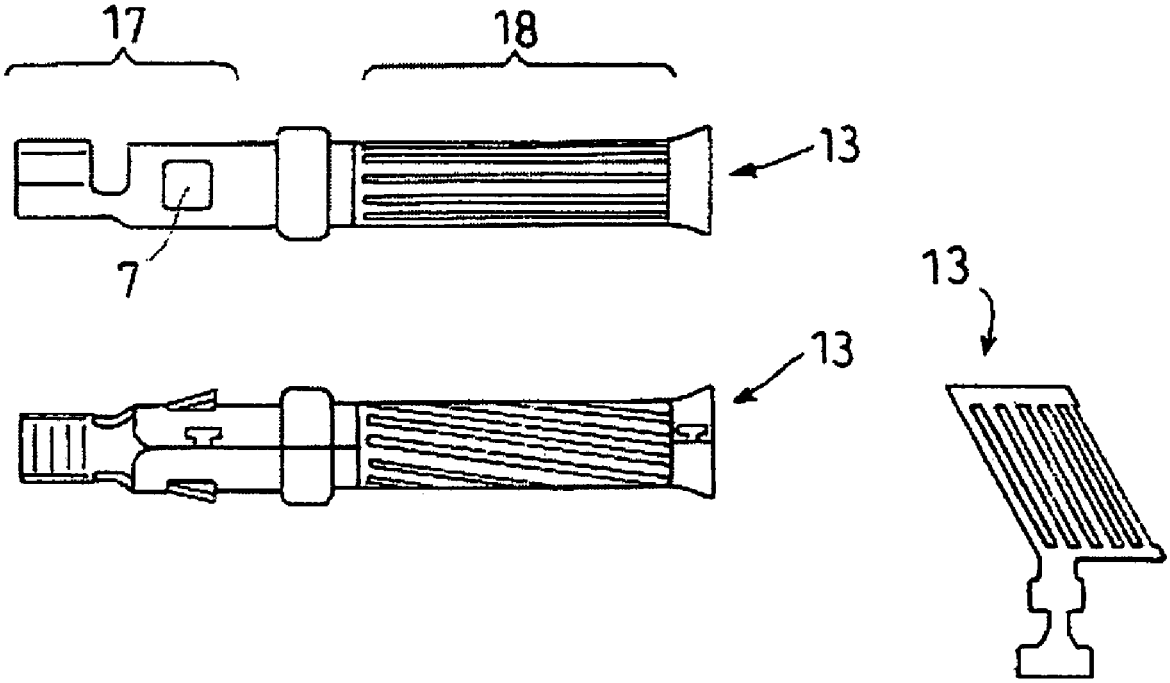
FIG. 4 is a contact sleeve with concave and twisted concave lamella.

FIG. 4 shows a contact sleeve 13 with concave lamella (upper illustration) and twisted concave lamella (lower illustration). The contact sleeve 13 that has already been shown in FIGS. 2 and 3 has at its one end a crimp region 17 by means of which the contact sleeve 13 can form a crimp connection with the cable. The other end has a contacting region 18, whereby this contacting region in the upper illustration is concave (that is inwardly bent) lamella (with respect to the longitudinal direction) through these concave lamella the contacting pressure on the contact pin 3 when the plug connection is made, can be increased as an alternative thereto according to the lower illustration in FIG. 4 the contact region 18 can be configured as a cage contact with twisted concave lamella. Such a contact sleeve can be manufactured simply as a stamped out bent part, whereby the stamped configuration shown for example to the right in FIG. 4 serves as a blank. The finished contact 13 is formed from that blank stamped out part illustrated at the right by rolling the sheet metal part, and it is also conceivable to use a contact sleeve 13 according to the upper illustration in FIG. 4 and to twist this only in the finished roll state into the contacting region 18. It is also conceivable to use other fabricating techniques and constructions to produce a cage contact with twisted concave lamella.

REFERENCE CHARACTER LIST

1. Coupling
2. Coupling Housing
3. Contact Pin
4. Cable
5. Annular Head
6. Shoulder
7. Detent Hook
8. Annular Projection
9. Seal
10. Sealing Ring
11. Eyes
12. Cable Conductor
13. Contact Sleeve
14. Plug Housing
15. Locking Hook
16. Plug
17. Crimp Region
18. Contacting Region

The invention claimed is:

1. In combination with two cables each having an outer jacket and an inner conductor projecting from the respective jacket, a connector assembly comprising:

a tubular plug housing extending along a respective longitudinal axis and formed with a radially inwardly projecting bead forming an axially outwardly directed shoulder and, axially outward from the bead, a radially enlarged region;

a contact plug in the plug housing and formed with a pin projecting axially inward from the respective bead and bearing axially outward on the respective bead, a pair of hooks axially outward of the respective bead and bearing axially inward on the shoulder thereof, whereby the hooks lock the contact plug in the plug housing, and a crimp connector axially outward of the respective bead and gripping the conductor of one of the cables;

a seal in the radially enlarged region of the plug housing and bearing radially inward on the jacket of the one cable whose conductor is gripped by the crimp connector of the contact plug;

a tubular socket housing extending along a respective longitudinal axis and formed with a radially inwardly projecting bead forming an axially outwardly directed shoulder and, axially outward from the respective bead, a radially enlarged region;

a contact socket in the socket housing and formed with a sleeve projecting axially inward from the respective bead and bearing axially outward on the respective bead, a pair of hooks axially outward of the respective bead and bearing axially inward on the shoulder thereof, whereby the hooks lock the contact socket in the socket housing, and a crimp connector axially outward of the respective bead and gripping the conductor of the other of the cables;

a seal in the radially enlarged region of the socket housing and bearing radially inward on the jacket of the other cable whose conductor is gripped by the crimp connector of the contact socket, the socket housing and the plug housing being fittable axially together with the cables extending axially oppositely away from each other and with the pin of the contact plug fitted snugly inside the sleeve of the socket housing, one of the housings being formed radially inward of the respective bead with a radially inwardly open groove; and a seal ring in the groove radially inwardly engaging the other of the housings when the housings are fitted together.

2. The combination according to claim 1 wherein the plug housing and the socket housing are made from plastic and the seals are made in common with the plug housing and the socket housing in a two-component technique.

3. The combination according to claim 1 characterized in that the seal each have a radially inner surface turned toward the respective cable and provided with circumferential grooves and ribs and forming a labyrinth seal.

4. The combination according to claim 1, wherein the plug housing and socket housing in the region of the respective seals are each provided with at least one longitudinally extending spreading gap or opening.

5. The combination according to claim 1 wherein the plug housing and the socket housing are made from a metallic material.

6. The combination according to claim 5 wherein in the making of the plug housing and the socket housing of metal, between it and the contact sleeve an insulating body is inserted.

7. The combination according to claim 1 wherein a part of the plug housing or the socket housing that engages around the other of the housings has eyes at its end turned away from the cable.

8. The combination according to claim 7 wherein the part of the plug housing or the socket housing which is received in the other housing, is provided with the eyes and the other housing has at its part corresponding locking hooks.

9. A method of making a plug or coupling of a combination according to claim 1 wherein the cable is fed through the plug housing or the socket housing and through the seal thereof, that the cable is isolated and the contact pin or the contact sleeve is connected by a crimp pliers with the cable conductor of the cable and that the plug housing or socket housing is shoved so further in the direction toward the contact sleeve with respect to the cable so that they lock in the plug housing or the socket housing.

* * * * *